US008474230B2

(12) United States Patent
Kempsell et al.

(10) Patent No.: US 8,474,230 B2
(45) Date of Patent: Jul. 2, 2013

(54) SADDLE TREE

(76) Inventors: David Kempsell, Canterbury (GB); Margaret Lesley White, Canterbury (GB)

( * ) Notice: Subject to any disclaimer, the term of this patent is extended or adjusted under 35 U.S.C. 154(b) by 410 days.

(21) Appl. No.: 12/226,903

(22) PCT Filed: May 3, 2007

(86) PCT No.: PCT/GB2007/050237

§ 371 (c)(1),
(2), (4) Date: Mar. 27, 2009

(87) PCT Pub. No.: WO2007/129117

PCT Pub. Date: Nov. 15, 2007

(65) Prior Publication Data

US 2009/0205296 A1 Aug. 20, 2009

(30) Foreign Application Priority Data

May 3, 2006 (GB) ..... 0608656.5

(51) Int. Cl.
*B68C 1/00* (2006.01)
*B68C 1/02* (2006.01)

(52) U.S. Cl.
USPC ..... 54/44.7; 54/44.1

(58) Field of Classification Search
USPC ..... 54/44.1, 44.5, 44.7, 46.1
IPC ..... B68G 1/00; B68C 1/00,1/02
See application file for complete search history.

(56) References Cited

U.S. PATENT DOCUMENTS

| | | | | |
|---|---|---|---|---|
| 135,755 | A | 2/1873 | Becker | |
| 3,293,828 | A | 12/1966 | Hessler | |
| 3,835,621 | A * | 9/1974 | Gorenschek | 54/44.7 |
| 4,965,988 | A * | 10/1990 | Anderson | 54/44.7 |
| 5,269,814 | A * | 12/1993 | Schmidt et al. | 8/94.27 |
| 5,517,808 | A * | 5/1996 | Schleese | 54/44.6 |
| 6,363,698 | B1 * | 4/2002 | Swain | 54/44.5 |
| 7,178,318 | B2 * | 2/2007 | Swain | 54/44.7 |
| 7,574,848 | B2 * | 8/2009 | Kempsell et al. | 54/44.7 |
| 2005/0011167 | A1 * | 1/2005 | Belton | 54/44.1 |
| 2005/0120683 | A1 * | 6/2005 | Swain | 54/44.1 |
| 2005/0126132 | A1 * | 6/2005 | Kempsell et al. | 54/44.1 |
| 2008/0086988 | A1 * | 4/2008 | Ruiz Diaz | 54/44.3 |

FOREIGN PATENT DOCUMENTS

| | | |
|---|---|---|
| GB | 171 333 | 11/1921 |
| WO | WO 03/089367 | 10/2003 |

OTHER PUBLICATIONS

Written Opinion of the International Searching Authority for PCT/GB2007/050237, dated Mar. 11, 2008.

* cited by examiner

*Primary Examiner* — Rob Swiatek
*Assistant Examiner* — Kathleen Iwasaki
(74) *Attorney, Agent, or Firm* — Buchanan Ingersoll & Rooney PC

(57) ABSTRACT

The present invention relates to improvements in or relating to saddles and saddle trees, especially English saddle trees, particularly for horses. In particular, we describe a method of manufacture for a tree which is simplified by the use of leather, webbing and plastic in flat sheet material. This fabrication can be simply stitched and riveted together and a Y-bar and headplate are then bolted and or riveted to the finished leather plastic fabrication. This method of making a tree is fast, efficient, cost effective, safe, reliable, provides more consistent symmetrical performance, and above all is very light, providing a weight saving of 60% compared with conventional methods. The tree fabrication requires no additional finishing or tidying, unlike other forms of manufacture. As soon as the parts are assembled they are ready to go to the next stage of making the finished seat for the saddle.

21 Claims, 4 Drawing Sheets

PRIOR ART

SADDLE TREE

This application is a national stage application under 35 USC §371 of International Application Number PCT/GB2007/050237, filed May 3, 2007, the International application being published in English. This application also claims priority under 35 USC §119 to Great Britain Application No. 0608656.5, filed May 3, 2006, the entire contents of each is hereby incorporated by reference.

The present invention relates to improvements in or relating to saddles and saddle trees, especially English saddle trees, particularly for horses.

A saddle tree (hereafter referred to simply as the tree) is the structure or frame on which the component parts of the saddle are affixed. It is the foundation of the saddle and is therefore dictates the final look and fit of the finished saddle. Trees are produced in different styles, which are dictated mainly by the shape and height of the cantle affixed at the rear of the tree and also the curvature of the tree in the longitudinal plane. The tree performs many different functions:

a. It is a relatively solid structure, which is used to transfer the weight of the rider evenly over the horse's back via two padded panels either side of the horse's backbone. Using a tree ensures that the area of bearing surface on the horse is much larger than if the rider were to sit on the horse bareback and therefore this larger area exerts less average pressure on the horse's back.
b. It allows for the formation of an arch, which holds the seat up clear of the withers, the spiny protuberance of the horse's spine under and in front of the front of the saddle. This arch will bridge the spine roughly 5 cm behind the end of scapula.
c. It allows the saddler to construct a seat for the rider, normally of foam or some other soft medium suitable for the comfort of the rider.
d. It allows for the solid fixing of the girth straps that allow the girth, a belt like piece of tack, to attach to the saddle's girth straps via buckles on each end of it. The girth passes under the horse's rib cage securing to the saddle's girth straps on either side of the saddle so keeping the saddle in place when ridden.
e. It provides a fixing for stirrup bars. These are hook-like metal components over which the stirrup leathers loop. They allow the rider to transfer their weight from the seat of the saddle by standing in the stirrups for rising or posting to the trot or when jumping the horse. The stirrup bar allows the stirrup leathers to slide off in an emergency i.e. the rider falls but traps their foot in the stirrup and instead of being dragged the stirrup leather pulls off the saddle. The hooks obviously point to the rear of the saddle.
f. It provides a base to or upon which all the leather or other material parts or fabric of the saddle can be affixed. This is normally with tacks, staples and glue.

Originally all trees were made of wood, normally beech. Now, 1.5 mm beech ply constructed from three 0.5 mm plies which have been cut to shape and placed on a 3D former, is used. The tree is built up in layers to the required thickness, typically 6-10 mm thick. A cantle is affixed to the raw wooden laminated frame. The tree is then reinforced by riveting pieces of metal, normally steel or spring steel to the beech tree. There are British and other Standards that specify the type and thickness of steel and the required number and quality of fixings. It should be noted that to stop parasitic infestation and subsequent deterioration of the wood, the wood is normally covered in a material soaked in a preparation that forms a coating layer on the tree. The tree and cantle thus become a single solid construction and cannot be easily altered. This style of construction requires investment in rigid, normally metal, formers for each size and type of tree together with ovens or heating apparatus to set the glues. The process of making the tree requires a considerable amount of time and the construction has to be carefully monitored to ensure that the finished product is symmetrical and square.

Many manufacturers have turned to plastics injection moulding techniques. This is expensive and allows for only one style and size of tree per mould and therefore requires many expensive moulds to be made to provide the various styles and sizes of tree required. Dependent on the properties of the plastics used and their final thickness, it is often still necessary to reinforce the tree with metal. The main disadvantage for using plastic is that the tree becomes very rigid and heavy. To achieve the same strength as traditional wooden trees, the plastic versions normally have to be thicker.

In our earlier patent application, WO 03/089367, we describe making a tree which can twist and move laterally with the horse without the ability to bend longitudinally. The tree is constructed by a process of loading rigid components and female bolt fittings into a mould to provide a solid structure to both sit on and to affix saddle parts to by means of bolts, staples and screws. The mould is then filled with a polyurethane castomer, a rubber-like resin, which binds all these components together and forms the shape of the tree. Being a synthetic rubber, the tree can distort and twist as the horse requires but the rigid components moulded inside provide structure and limit the movement to the planes required. Although providing an excellent tree, this method is also a messy process which again requires costly moulds for each shape and size of tree.

In essence, WO 03/089367 provides a tree that comprises substantially two components, a Y-shaped carbon fibre bar and a headplate, suitably steel or other material. The shape, orientation to one another and size of these components give a solid framework by which to transfer the weight of the rider through to the horse's back.

The polyurethane cast around these components: i) holds the two substantive structures of the saddle; the Y-bar and the headplate, together; and ii) provides fabrication of the shape of an English riding saddle's tree, in other words, adapts the Y-bar and headplate shapes to resemble an English saddle's tree.

This method of construction, whilst highly suitable for the purpose, does create a saddle tree of some considerable weight, typically around 2 kg. To start with this weight, before loading the tree with all the other necessary components of a saddle, makes the finished saddle heavier than would be desirable. Polyurethane castomers are weaker than plastics formed into sheet material or those used for plastic injection moulding. Therefore one has to use more of the castomer to achieve the desired strength.

With the above in mind, the present invention seeks to provide an English saddle tree having the advantages outlined in WO 03/089367 and which can be made:

- without the need for glues or chemicals that give rise to possible commercial health and safety concerns or considerations.
- without reliance on moulds, thus giving the advantage of being able to change designs sizes and styles without the need of costly tooling and mould-making that is the norm.
- with a considerable weight saving without compromising strength.

Advantageously, the tree still utilizes rigid components to provide suitable fixing points, control the stability and limit the movement in the tree where required, whilst providing a means of movement where desired.

The present invention provides a method of manufacture for a tree generally as outlined in WO 03/089367 where the messy and costly method of making the fabrication of the tree shape around the two substantive components is simplified by the use of leather, webbing and plastic in flat sheet material. This fabrication is stitched and riveted together and the Y-bar and headplate are then bolted and or riveted to the finished leather plastic fabrication.

This method of making a tree is fast, efficient, cost effective, safe, reliable, provides more consistent symmetrical performance, and above all is very light, being around 800 g, a weight saving of 60%. The tree fabrication requires no additional finishing or tidying, unlike other forms of manufacture. As soon as the parts are assembled they are ready to go to the next stage of making the finished seat for the saddle.

The present invention also provides a saddle tree of the type obtainable by this method and a saddle incorporating such a tree.

In particular, according to the present invention there is provided a saddle tree comprising a saddle tree plate carrying a headplate leather and a saddle tree leather.

Preferably, the saddle tree further comprises left and right stirrup bars mounted upon the saddle tree plate. More preferably, the stirrup bars are mounted on a lower surface of the saddle tree plate and the saddle tree further comprises a stirrup reinforcement plate associated with each stirrup bar, the stirrup reinforcement plate being mounted on an upper surface of the saddle tree plate.

Preferably, the saddle tree further comprises a back fixing plate providing attachment points for flaps and panels in a finished saddle.

Preferably, the saddle tree further comprises a Y-shaped reinforcement bar, suitably formed from carbon fibre.

Preferably, the saddle tree plate has a forward portion defining a headplate area and a rearward portion, comprising a pair of arms, defining a saddle body portion.

Preferably, the saddle tree further comprises a spacer plate adapted to hold arms in a spaced configuration.

Preferably, the saddle tree leather comprises a left main saddle tree leather, a right main saddle tree leather and a leather spacer.

Preferably, the saddle tree plate is formed from a resilient deformable material, more preferably a sheet material.

Preferably, the spacer plate is formed from a sheet material.

Suitably, the sheet material is a plastics material, more suitably, a polymeric material. Advantageously, the polymeric material is a polypropylene.

Preferably, the sheet material has a thickness of from 0.5 mm to 3.5 mm, more preferably from 1 mm to 3 mm, most preferably about 2 mm.

Preferably, the saddle tree further comprises a headplate. More preferably, the headplate is mounted on the saddle tree plate in a channel defined by headplate leather and saddle tree leather.

Suitably, the headplate and saddle tree leathers are secured upon the saddle tree plate by means of stitching.

Preferably, the headplate and saddle tree leathers are butt leather, suitably having a thickness of 2 mm to 6 mm, more suitably 4 mm to 5 mm.

The present invention also provides a saddle comprising a saddle tree as described above.

The present invention further provides a method of manufacturing a saddle tree, the method comprising forming a saddle tree plate, providing a headplate leather and a saddle tree leather and securing the leathers to the saddle tree plate.

Preferably, the leathers are secured by stitching the leathers to the saddle tree plate.

The above and other aspects of the present invention will now be illustrated in further detail, by way of example only, with reference to the accompanying figures in which.

Figure 1:
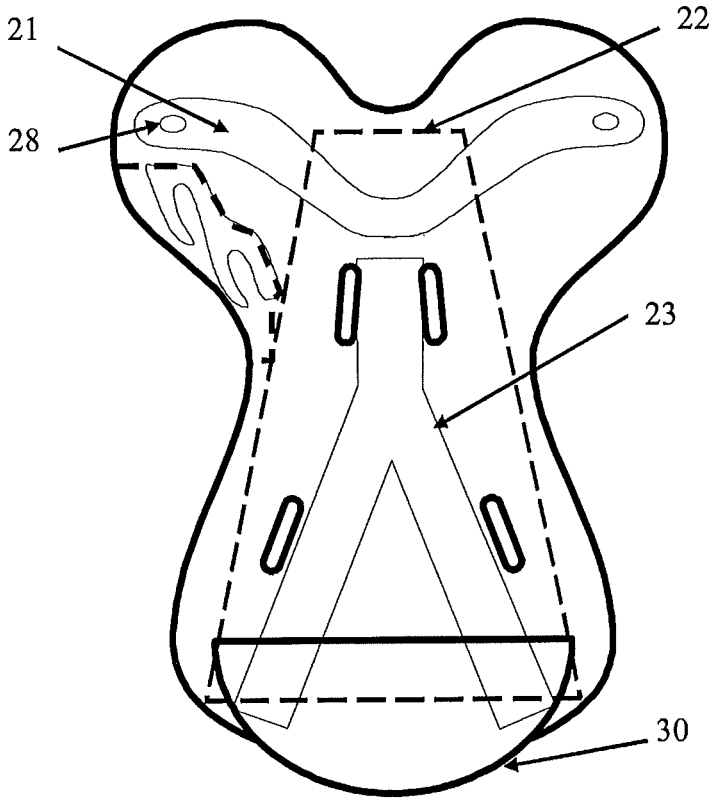
FIG. 1 illustrates the prior art saddle tree construction of WO 03/089367.

To illustrate the present invention, it is convenient to outline the construction of the saddle tree of WO 03/089367 with reference to FIG. 1. There are two substantive components, that is to say, parts that provide structure and strength to the saddle's tree, the headplate 21 (in the illustrated embodiment, this is detachable via bolts located through holes 28) and the carbon-fibre Y-bar 23. The rest of the construction provides means to create a shape upon which it is convenient to make a riding saddle. The carbon-fibre mat 22 and the resin are formed in a mould to create a saddle tree that is flexible whilst at the same time strong enough to hold tacks, screws and staples required for the construction of the saddle. It is this peripheral flexible construction that concerns us in the present invention.

Figure 2:
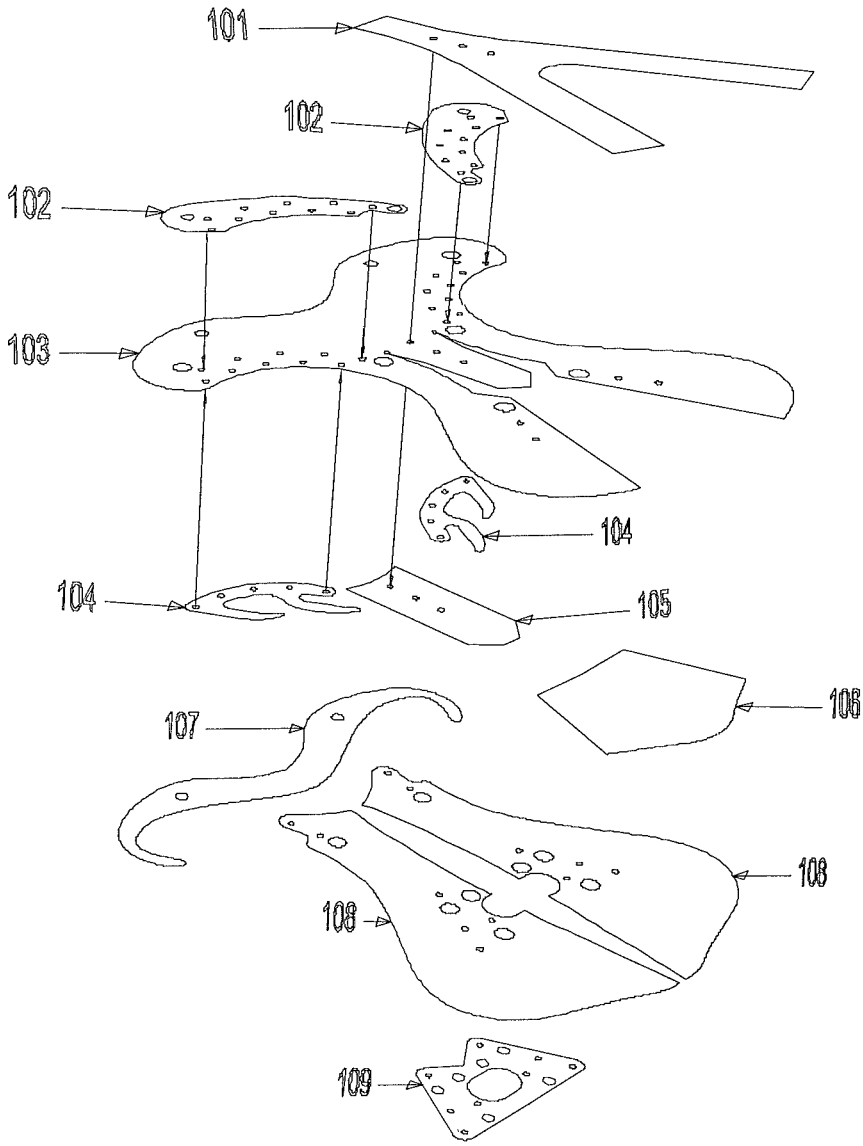
FIG. 2 illustrates an embodiment of the present invention in an exploded view showing all the components and their orientation to one another.
Figure 3:
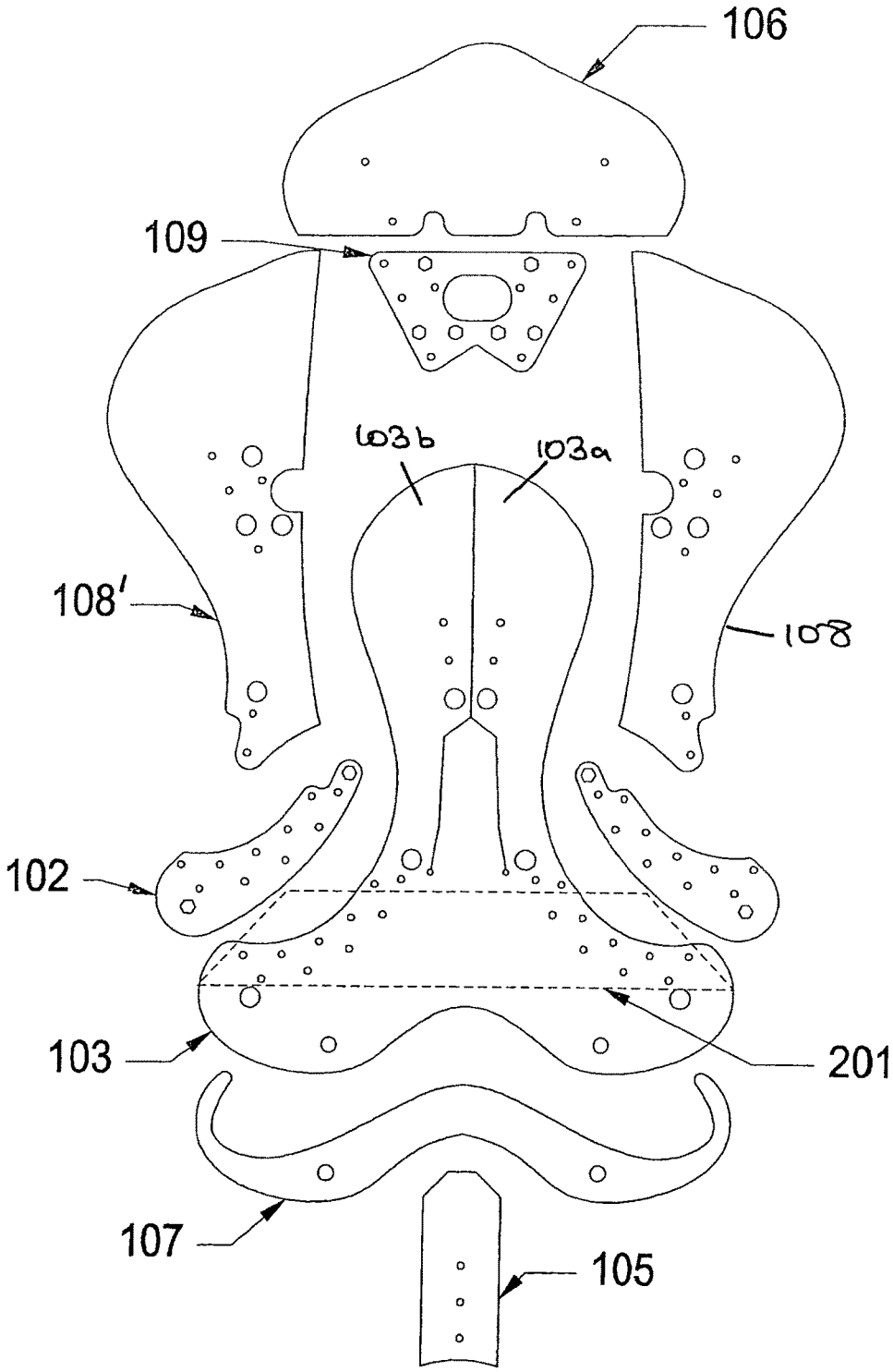
FIG. 3 illustrates the components of FIG. 2 as they are cut from flat material.

With reference to FIGS. 2 & 3, the components that make up a saddle tree comprise:

101 Reinforcing Y-Bar to provide strength and rigidity longitudinally, suitably of carbon fibre as disclosed in WO 03/089367. Unlike in the prior art, wherein the Y-Bar is embedded in a polyurethane resin, the Y-bar 101 is secured to the rest of the tree fabrication, for example, by the use of stainless steel pot rivets or bolts.

102 Stirrup Reinforcement Plate—typically Stainless Steel 1.2 mm, suitably made by laser cutting or other suitable method from flat sheet 1.2 mm thick stainless steel sheet of EN 304 grade to the appropriate shape. Plate 102 is used to secure stirrup bars 104 to the saddle tree plate 103 (below). In the embodiment shown, therefore, ten holes for securing rivets, five to secure the stirrup reinforcement plate 102 to saddle tree plate 103 and leather 108 of the tree fabrication, and five to secure the stirrup bar 104 not only to stirrup reinforcement plate 102 but also to plate 103 as well. The two larger hexagonal holes are used for a proprietary M6 (6 mm threaded) hexagonal rivet nut fixing which is inserted into the hexagonal hole and compressed using a specially designed tool for the purpose therefore effectively making a captive nut fixing. One of these fixings is used to secure the headplate in place in the finished tree using two M6 bolts and washers. When the saddle is in use, a headplate has to be fitted and these two rivet nut fixing points also help to strengthen the stirrup bar 104 fixing to the tree fabrication by adding yet another fixing point to the reinforcing plate 102.

103 Saddle tree plate—suitably of 2 mm polypropylene. Polypropylene sheet is easily cut by water jet, laser or can be simply stamped out of flat sheet material, thereby allowing accuracy of construction symmetry of fixing points and overall shape. This plate is the substantive part of the tree fabrication. It provides the properties required i.e.

is relatively stiff but can be deformed to the desired shape; will, in combination, with leather provide an excellent substrate into which to secure staples when affixing leather for the seat covering; has good tear strength for suitable fixing of components likely to exert tensile forces on the tree;

is not unduly stressed or fatigued by continual movement; is very resilient to abrasion; and being sheet material, it is uniform and normally made to a tight tolerance. This means that, in this application, the amount of flexion and deformation will be consistent between manufactured trees.

In FIG. 2, saddle tree plate 103 is shown in a deformed state. In FIG. 3, the plate 103 is shown as it would be cut. A central Y-shaped slit running for most of the length of plate 103 divides the plate into a pair of arms 103*a*, 103*b* and allows the plate to be deformed to take on the shape of an English saddle tree. When the halves are pulled apart (as in FIG. 2), the plate will not remain flat but will distort in a three-dimensional fashion, taking on the curved appearance of a saddle tree. This distorted shape is maintained by the attachment of the other components that make up tree fabrication 100 as described hereafter.

In FIG. 3, the polygonal shape outlined as a dashed line represents webbing (201), similar to that used in seat belts of cars. This lightweight, very strong, material can be used to provide a bridge between the stirrup bars 104 either side of the tree, spreading the load taken by the stirrups when in use over the whole of the front tree fabrication. It also covers the arch of the headplate, ensuring transfer of forces to the headplate as well. Being made typically of polyester, the web can be trimmed using a hot knife or similar easy means ensuring that the web is sealed and will not fray or run when put under strain. The web shown is not trimmed to the shape of tree.

104 Stirrup bars—suitably of either 4 mm stainless steel or 5 mm mild steel plate, machined to round the edges or cast by a lost wax process. Securable to the tree using the five fixing points mentioned above, preferably using stainless steel pot rivets through the saddle tree plate 103 to stirrup reinforcing plate 102 and hence to the rest of the tree fabrication.

105 Leather spacer—suitably 4-5 mm butt leather. Leather spacer 105 is used in combination with saddle tree leather 108 to provide a stop at the rear of the headplate channel 210 created between headplate leather 107 and the end of leathers 108 & 105 combined to prevent the headplate when fitted from rotating backwards.

106 Spacer plate—suitably of polypropylene or other material with similar properties. Spacer plate 106 is fixed to Y-bar 101 and saddle tree plate 103 to hold the two halves of plate 103 in a spaced configuration at the rear of the tree. These components can be easily affixed by stitching 200 and rivets to the rest of the tree.

107 Headplate leather—suitably 4.5 mm butt leather. Headplate leather 107, resembling a bull's horns, creates a headplate channel 210 into which headplate can be affixed by the use of M6 bolts (in the manner described in WO 03/089367 and as shown in FIG. 1).

108 Main saddle tree leathers (left and right)—suitably 4-5 mm butt leather. The handed leather shapes 108 are cut with a curve on their mirrored edge. Leather spacer 105 and spacer plate 106 are stitched to the two main saddle tree leathers 108 in such a leather spacer way that their curved edges meet along the longitudinal centerlines of leather spacer 105 and spacer plate 106. When stitched together the four combined leathers distort to take on the appearance of the under side of an English saddle tree.

The leather components 105, 107, 108 are used to provide:

a. areas where, in combination with the saddle tree plate 103, they will provide secure fixing for staples etc; and b. a three-dimensional shaped feature on the underside of the tree, namely a recess for the headplate in the finished tree (the space between leather spacer 105, spacer plate 106, headplate leather 107 and main saddle tree leathers 108).

109 Back Fixing Plate—typically 1.2 mm stainless steel, suitably cut from sheet stainless steel by laser or other means. This plate provides for fixing points for the attachment of flaps and panels of the finished saddle. The hexagonal holes provide for M6 rivet nut fixings. The smaller round holes allow stainless steel pot rivets to pass through. There are corresponding holes in main saddle tree leathers 108 then back fixing plate 109 then saddle tree plate 103 and finally through carbon-fibre Y-Bar 101. Thus, riveting through these holes joins and secures the saddle tree fabrication to the substantive component of the completed tree, the Y-Bar 101.

The finished saddle tree will have a cantle 30 (see FIG. 1) which forms a support at the rear-most part of tree. This is normally a piece of shaped plywood, but can be made from other materials. Cantles come in different shapes to suit the different riding disciplines and personal tastes, and can be easily affixed to our finished tree by the use of screws. Moreover, it is advantageous not to affix a cantle until the style of the tree is decided and therefore a stock of trees without cantles 30 can be on the shelf awaiting their final design. Y-bar 101 can be manufactured with different degrees of curvature in the longitudinal plane to create even more styles of finished tree over and above those style changes made by affixing different cantle plates. These features alone provide a manufacturer with greater flexibility of working stock. Hence this is very helpful to stocking levels of trees and therefore has a positive impact on cash flow.

Figure 4:
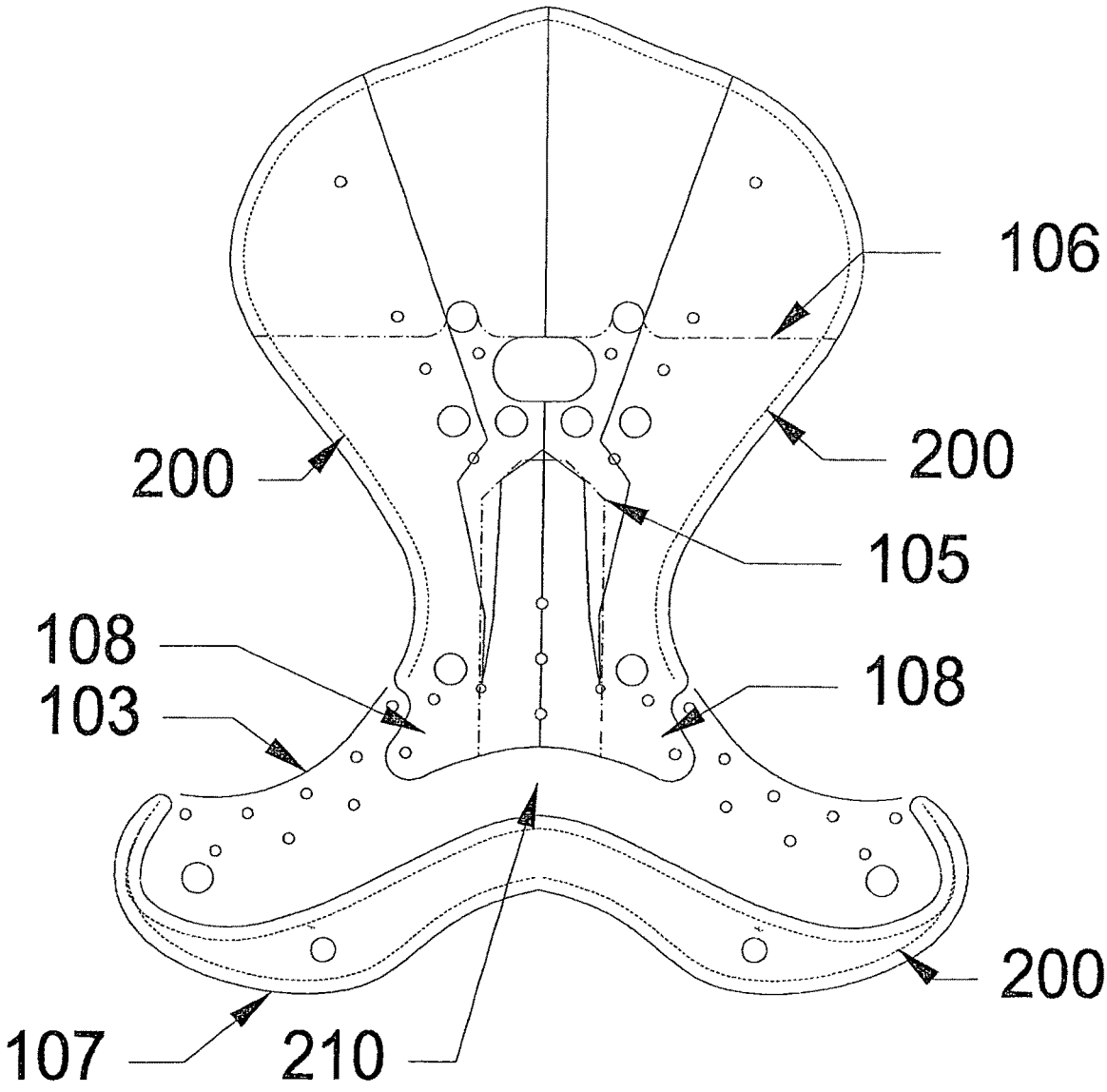
FIG. 4 illustrates the embodiment of FIG. 2 showing stitching of the components.

FIG. 4 illustrates the saddle tree plate 103 and the leather spacers 105, spacer plate 106, headplate leather 107 and main saddle tree leathers 108 and how they are stitched together. The operation of stitching these items together is straightforward and provides one of the distinct advantages of the present invention. The amount of stitching (dotted lines 200) is very small and can be completed in a matter of minutes. The same can be said of the construction of the riveted parts. The main advantage to this tree construction (barring the obvious benefit of the construction of the carbon fibre Y-bar 101) is the speed of manufacture of a finished tree.

There is no requirement for a special environment to manufacture the saddle trees as no ovens, glues, moulds or chemicals are required as in all other types of tree manufacturing methods. The whole process can be carried out within the saddlery workshop with just a sewing machine and a rivet gun. There are no special health and safety, environmental disposal or specialized equipment requirements.

Within the industry, great emphasis is placed on the manufacture of symmetrically square trees. Conventional tree manufacture works to a tolerance of ±2 mm. In other words, it is considered acceptable for the tree can be out by as much as 4 mm in any one plane. With our inventive method of construction, the tolerances are greatly reduced, to as little as ±0.25 mm, as everything can be cut from flat sheet material in one operation. All fixing points are predetermined and accurately located.

Another advantage of this design of tree is that the tree can be manufactured in volume as a single base shape from which all variant styles can be created by affixing different cantles 30 and/or a different Y-bar 101. Whilst we have explained a method of speedy and cost effective manufacture of a saddle tree to very tight tolerances using a Y-bar construction as outlined in WO 03/089367, the inventive method is equally applicable to the construction and manufacture of more standard types of saddle tree. In other words, it is possible to use other shapes of framework other than the Y-bar 101 and/or headplate to provide the rigid structure on to which the remainder of the components in the tree can be affixed.

The present invention takes the concept provided in WO 03/089367 and provides a tree and a means of construction that is more commercially advantageous in that it is easier, cleaner, safer to produce than its counterpart. It provides all the same functionality, as before but because of its use of uniform materials the performance of the finished product is more consistent, and is symmetrical and uniform. It also allows for the final style of the tree to be decided at the time when it is to be incorporated into a saddle rather than having to make a working stock of each style of tree. In other words, the present invention provides a tree which can become any style, or changed to any other style easily at any point.

The process of casting resins brings challenges and obstacles to over came such as irregular air entrapment in the mould etc. This is exacerbated by the introduction of components that the resin then has to flow around to encapsulate. Also, moulding polyurethane requires staff that are skilled in this type of work and are well trained in the health and safety procedures. Also, the question of the safe disposal of the resin components all adds to the overheads of this type of construction. To change or make one-off types of tree with this method is very difficult and very expensive, as a new mould is invariably required.

The invention claimed is:

1. A saddle tree comprising:

a saddle tree plate formed of a resiliently deformable material, and having a longitudinal generally Y-shaped slit defining a headplate area and a pair of saddle tree plate arms wherein, when the saddle tree plate arms are pulled apart, the Y-shaped slit allows the saddle tree plate to deform in a three-dimensional fashion to take on a curved configuration of a saddle tree;

a spacer plate attachable to said saddle tree plate arms to hold said saddle tree plate arms in a predetermined spaced position so as to hold the saddle tree plate in the curved configuration;

a headplate leather mounted to the headplate area of said saddle tree plate;

a saddle tree leather secured to said saddle tree plate; and a reinforcing bar secured longitudinally to said saddle tree plate.

2. A saddle tree as claimed in claim 1, further comprising left and right stirrup bars mounted upon the saddle tree plate.

3. A saddle tree as claimed in claim 2, wherein the stirrup bars are mounted on a lower surface of the saddle tree plate and the saddle tree further comprises a stirrup reinforcement plate associated with each stirrup bar, the stirrup reinforcement plate being mounted on an upper surface of the saddle tree plate.

4. A saddle tree as claimed in claim 1, further comprising a back fixing plate providing attachment points for flaps and panels in a finished saddle.

5. A saddle tree as claimed in claim 1, wherein the reinforcing bar is a Y-shaped reinforcement bar longitudinally mounted to said saddle tree plate.

6. A saddle tree as claimed in claim 1, wherein the saddle tree plate has a forward portion defining the headplate area and a rearward portion, comprising the pair of saddle tree plate arms, and defining a saddle body portion.

7. A saddle tree as claimed in claim 1, wherein the saddle tree leather comprises a left main saddle tree leather, a right main saddle tree leather and a leather spacer.

8. A saddle tree as claimed in claim 1, wherein the saddle tree plate is formed from a sheet material.

9. A saddle tree as claimed in claim 8, wherein the sheet material is a plastics material.

10. A saddle tree as claimed in claim 9, wherein the plastics material is a polymeric material.

11. A saddle tree as claimed in claim 10, wherein the polymeric material is polypropylene.

12. A saddle tree as claimed in claim 1, wherein the spacer plate is formed from a sheet material.

13. A saddle tree as claimed in claim 12 wherein the sheet material has a thickness of from 0.5 mm to 3.5 mm.

14. A saddle tree as claimed in claim 1, further comprising a headplate.

15. A saddle tree as claimed in claim 14, wherein the headplate is mounted on the saddle tree plate in a channel defined by the headplate leather and the saddle tree leather.

16. A saddle tree as claimed in claim 1, wherein the headplate leather and the saddle tree leather are secured upon the saddle tree plate by means of stitching.

17. A saddle tree as claimed in claim 1, wherein the headplate leather and the saddle tree leather are butt leather, suitably having a thickness of 2 mm to 6 mm.

18. A saddle tree as claimed in claim 1, wherein said headplate leather and said saddle tree leather are separate and distinct pieces of leather secured directly to said saddle tree plate.

19. A method of manufacturing a saddle tree, comprising:

forming a saddle tree plate from a resiliently deformable material, the saddle tree plate having a longitudinally Y-shaped slit defining a headplate area and a pair of saddle tree arms;

pulling apart the saddle tree arms so that the Y-shaped slit allows the saddle tree plate to deform in a three-dimensional fashion to take on a curved configuration of a saddle tree;

attaching a spacer plate to said saddle tree arms to hold said arms in a predetermined spaced configuration so as to hold the saddle tree plate in the curved configuration;

securing a headplate leather to the headplate area of said saddle tree plate;

securing a saddle tree leather to said saddle tree plate; and securing a reinforcing bar longitudinally to said saddle tree plate.

20. A method as claimed in claim 19, wherein the leathers are secured by stitching the leathers to the saddle tree plate.

21. A method as claimed in claim 19, further comprising forming the headplate leather and the saddle tree leather from separate and distinct pieces of leather, and securing the headplate leather and the saddle tree leather directly to the saddle tree plate.

* * * * *